US006527030B2

(12) United States Patent
Ueno

(10) Patent No.: US 6,527,030 B2
(45) Date of Patent: Mar. 4, 2003

(54) SEALING IMPLEMENT

(75) Inventor: Hideyuki Ueno, Yokohama (JP)

(73) Assignee: Kotec's Co., Ltd., Tokyo (JP)

( * ) Notice: Subject to any disclaimer, the term of this patent is extended or adjusted under 35 U.S.C. 154(b) by 6 days.

(21) Appl. No.: 09/941,632

(22) Filed: Aug. 30, 2001

(65) Prior Publication Data

US 2002/0023724 A1 Feb. 28, 2002

(30) Foreign Application Priority Data

Aug. 30, 2000 (JP) ..... 2000-261158
Aug. 27, 2001 (JP) ..... 2001-256165

(51) Int. Cl.[7] ..... B65D 63/00

(52) U.S. Cl. ..... 156/581; 24/16 PB; 24/17 AP; 24/30.5 P

(58) Field of Search ..... 156/580, 581; 24/16 PB, 17 AP, 30.5 P; 292/318, 319, 321

(56) References Cited

U.S. PATENT DOCUMENTS 4,854,014 A * 8/1989 Ueno ..... 24/16 PB
5,799,375 A * 9/1998 Fukami ..... 24/16 PB
5,908,110 A * 6/1999 Hirai ..... 206/345
6,126,056 A * 10/2000 Ueno et al. ..... 227/67
6,446,311 B1 * 9/2002 Ueno ..... 24/16 R

* cited by examiner

*Primary Examiner*—James Sells
(74) *Attorney, Agent, or Firm*—Bacon & Thomas, PLLC

(57) ABSTRACT

The present invention provides an unit of sealing implement comprising a plurality of single sealing implements each one of which comprising, a flexible filament part, an insertion head part having an appropriate engaging part provided on one end part of said filament part, and a socket part having a hole for the purpose of irreversibly inserting said insertion head part, and provided on another end of said filament, and wherein a plurality of said single sealing implements are mutually and adjacently arranged in parallel with each other and each of said plurality of insertion head parts or a portion proximity thereto and each of said plurality of socket parts or a portion proximity thereto being caused to be connected to separately provided connecting bars, respectively, and further wherein each of side wall surfaces of said socket part each being adjacently arranged to each other, and which being oppositely disposed to each other, are connected with each other via a connecting means and by using this sealing implement, no malfunction of a gun or no jamming condition generated on the gun are expected.

18 Claims, 10 Drawing Sheets

(A)

(B)

(A)

(B)

SEALING IMPLEMENT

BACKGROUND OF THE INVENTION

1. Field of the Invention

The present invention relates to a sealing implement for attaching a sealing tags such as bland labels, price tags, material description, instruction manual, etc. to cloths, shoes, bags, and other products, and more particularly to a sealing implement that can be smoothly attach tags when it is set to a special-purpose tag attaching tool (gun) for attaching tags as specified above.

2. Description of the Prior Art

In general, a various kinds of sealing implements have been used for banding together clothes, women's boots, sandals, shoes, etc. or for attaching bland labels, price tags, etc.

For example, the sealing implement comprises a filament section for forming a loop by passing a tag, an insertion head part provided on one end of the filament part, and a socket part provided with an insertion hole for allowing the relevant inserting head part to pass, and provided on another end of the filament section. And a plurality of sealing implements are temporarily fixed to two bars 11 arranged in parallel to one another in such a manner so as to enable the socket part to be easily removed.

Further, such sealing implement is produced by being integrally molded preferably with synthetic resin or the like, and in particular, the filament section is elongated so as to exhibit extremely strong resistance against pulling operation. When the inserting head section penetrates the narrow part of the socket section, a latching piece, which is a hook mounted near the insertion hole, opens, and this causes the neck part of the insertion head part is reversibly fixed in the socket part, and a loop-form label attaching condition is completed, and sealing is achieved.

Conventionally, these sealing implements are loaded in a special-purpose tag attaching tool (gun), and it is used not only for banding together boots, sandals, and shoes but also primarily for fixing bland labels and tags T that carry the instruction manual of a product on such goods by pulling the lever.

On the other hand, in the past, many kinds of apparatus for using to shot this sealing implement for attaching the same on a good or the like by forming the filament part thereof into a loop like shape with a suitable tag or the like, had been used with deferent mechanism from each other.

On of such examples will be explained with reference to FIG. 4, hereunder.

Note that, FIG. 4 shows a perspective view of a configuration of one example of such conventional tag attaching tool (gun) 18 as shown in U.S. Pat. No. 5,799,375 or U.S. Pat. No. 5,908,110.

When it is used, a conventional unit of sealing implements 10 as shown in FIG. 6, which is disclosed in U.S. Pat. No. 5,908,110 is mounted on an upper surface 30 of this gun 18 by making a shape of the sealing implement into U type configuration and then each one of the sealing implements 1 is separated from the connecting bar, respectively, by operating an operating lever 18*a* as one of examples of an operating means, thereby the insertion head part 13 and the socket part 15 can be coupled to each other.

The further explanation for this gun 18 will be done hereunder.

FIG. 4 is a perspective view showing the condition in which the sealing implement according to the present invention is set to the gun 18.

Now, to the gun 18, vertical grooves 21, 22 are formed on the right and the left side of the gun for inserting the connecting bars 11, 11' of the sealing implement 10. To the vertical groove 21, for example, the connecting bar 11 connecting the socket section 15 of the sealing implement 10 is inserted, and to the vertical groove 22, the connecting bar 11' connecting the inserting head section 13 is inserted.

In addition, on the gun 18, a shooting mechanism for shooting such sealing implement as shown in FIG. 5 is provided, in that at a side portion of the vertical groove 21, a first pushing means 40 for separating each one of the socket part 15 of the sealing implement 1 from a connecting portion of the connecting bar 11 and for pushing forward each one of the separated socket part 15 one by one along a curved socket guide 26.

The first pushing means 40 comprises a flexible belt 41 having a rack portion and a gear portion 42 for sliding the flexible belt 41 back and forth by mating with the rack portion.

Therefore, in the conventional embodiment, at every time when the lever 18*a* is operated, a tip end portion 43 of the flexible belt 41 attaches to a surface 44 of the socket part 15 which is as surface to which the filament part 12 is contacted, and then the tip end portion 43 of the flexible belt 41 separates the socket part 15 from the connecting part of the connecting bar 11 after that it transfer the socket part 15 to a front end portion of the curved socket guide 26.

On the other hand, at a side portion of the vertical groove 22, it is provided a second pushing means 45 which separates the insertion head part 13 of the sealing implement 1 from the connecting part of the connecting bar 11' and pushes each one of the insertion head part 13 forward to the front end portion of the curved socket quid 26, one by one.

The second pushing means 45 comprised a tubular guide 24 fixed to a main body of the gun 18 and a piston mechanism 47 having a gripping portion for gripping the insertion head part 13 at a tip portion thereof and which slides with response to an operation of the lever 18*a*.

When the piston portion 47 is slid forward, it moves toward the curved socket guide 26 by gripping the insertion head part 13 of the sealing implement 1 arranged inside of the tubular guide 24 at a tip portion thereof and inserts the insertion head part 13 into the insertion hole 14 for receiving the insertion head part 13 of the socket part 15 which had already arrived at the front end portion of the curved socket guide 26.

Note that, in the conventional embodiment, in order to move each one of the sealing implement 1 forming the unit of sealing implement 10 thus mounted on the gun 18, to a position to be shot out, respectively, the gun is provided with a gear mechanism 50, 50' as shown in FIG. 9, which can mate with each one of a connection portion formed between the insertion head part 13 or the socket part 15 and the connecting bar 11 or 11', respectively.

And thus, by making each one gear tooth of the gear portion of the gear mechanism 50, 50' to be rotated respectively, by utilizing a suitable cam mechanism or ratchet mechanism in response to the operation of the operating means 18*a*, it can be designed that the connecting bar can be moved downwardly by a length corresponding to a distance formed between the adjacently arranged sealing implements.

However, in the conventional sealing implement 10 described above, as shown in FIGS. 7(A) and FIG. 7(B), a contacting surface 44, one of the side wall surfaces of the socket part 15 of the sealing implement 10 and at which a filament part 12 is contacted, is formed with a curved surface and thus when the tip end portion 43 of the flexible belt 41 having a function for pushing out the socket part 15, is attached to the side wall surface 44, as shown in FIG. 8, an arranged direction of the socket part 15 is easily deformed from the originally arranged direction so that a direction of a longitudinal axis of the socket part 15 becomes different from a direction of a longitudinal axis of the filament part 12, resulting a head of the socket part 15 not to be smoothly inserted into the curved socket guide 26.

Therefore, there has been many cases in that the insertion operation for inserting the insertion head part 13 into an entrance portion of the curved socket guide 26 is discontinued so that so called jamming condition had been frequently occurred.

Further, during a storage of a plurality of the unit of sealing implements 10, when some kinds of load had been applied to the socket part 15, the direction of arrangement for each one of the socket part 15 would be deformed as shown in FIG. 8, the same problem as mentioned above, in that a front end of the socket part 15 cannot be smoothly inserted into the entrance portion of the curved socket guide 26 when the sealing implement 1 is shot, had been occurred.

Accordingly, by using the conventional sealing implement and the conventional gun, it is apparent that an operation efficiency thereof had been greatly reduced due to not only an occurrence of malfunction of the mechanism but also an occurrence of the jamming condition followed by stopping it operation as well as by performing a removing operation of the jammed portion.

That is to say, in using the conventional sealing implement and the conventional gun, the gun had not correctly operated causing to generate failure of shooting the sealing implement or a part of the sealing implement had been captured inside the gun causing extra operation for removing such captured part of the sealing implement and for resetting the sealing implement at every time when such problems had been occurred.

Accordingly, it is an object of the present invention to provide a sealing implement which make an operational efficiency in a mounting operation for mounting the sealing implement on a gun as well as to provide a sealing implement which is able to constantly maintain the correct direction of a socket part so as to avoid an occurrence of so called jamming condition.

SUMMARY OF THE INVENTION

In order to solve the above problems, the present invention basically adopts a configuration described as follows. That is, the present invention relates to a sealing implement comprising a flexible filament part, an insertion head part having an appropriate engaging part provided on one end part of the filament part; and a socket part having a hole for the purpose of irreversibly inserting the insertion head part, and provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, respectively, and further wherein each of side wall surfaces of the socket part each being adjacently arranged to each other, and which being oppositely disposed to each other, are connected with each other via a connecting means.

In order to resolve the above-mentioned problems, the unit of the sealing implement of the present invention has a technical conception in that at each one of the socket part of the sealing implement 1 each being parallely arranged to each other on the connecting bars, with interposing a predetermined distance thereinto, each of the side wall surfaces of the socket parts each adjacently arranged to each other and facing to each other is connected to each other with a suitable connecting means so that an arrangement configuration of each one of the socket part cannot be deformed so as to be solidly kept at a predetermined position when each one of the sealing implement is shot out by the gun, respectively.

Accordingly, in the present invention, even when an improper external force is applied to the unit of sealing implement during transportation or storage thereof, the directions of an arrangement of the socket part are not misaligned, and when the socket part 15 is separated from the connecting bar and is inserted into an entrance portion of the curved socket guide by the pushing means, there substantially be no chance in that a position of the socket part would be deformed with respect to an entrance portion of the curved socket guide so that it can be possible that the occurrence of the jamming condition can surely be prevented.

Therefore, in the present invention, an operational efficiency of the shooting operation of the sealing implement can be improved.

BRIEF DESCRIPTION OF THE DRAWINGS

FIG. 3(A) is a back side view showing the configuration of one specific example of the sealing implement related to the present invention and FIG. 3 (B) shows various kinds of connecting means as used in the present invention while FIGS. 3(C)–3(I) show various kinds of side view of connecting means as used in the present invention;

DETAILED DESCRIPTION OF THE PREFERRED EMBODIMENT

Referring now to drawings, description will be made in detail on the configuration of one specific example of the sealing implement related to the present invention.

Figure 1:
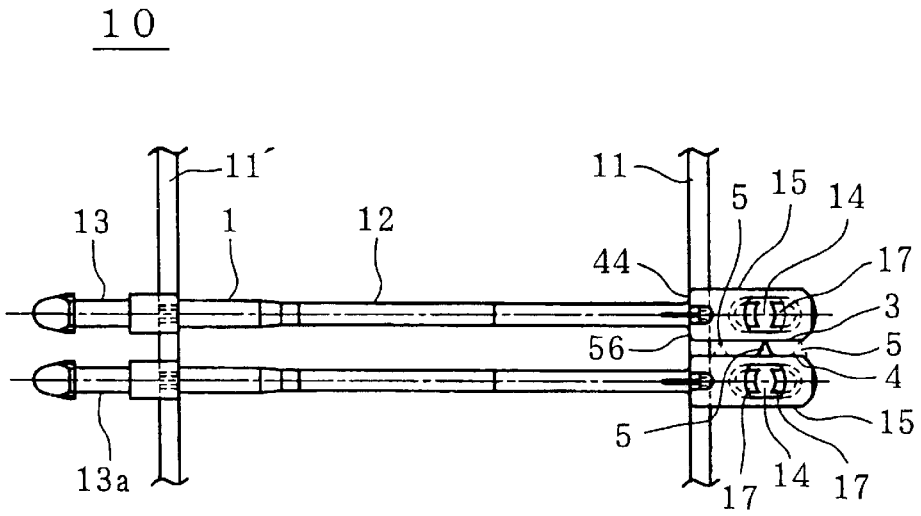
FIG. 1 is a front view showing the configuration of one specific example of the sealing implement related to the present invention.
Figure 2:
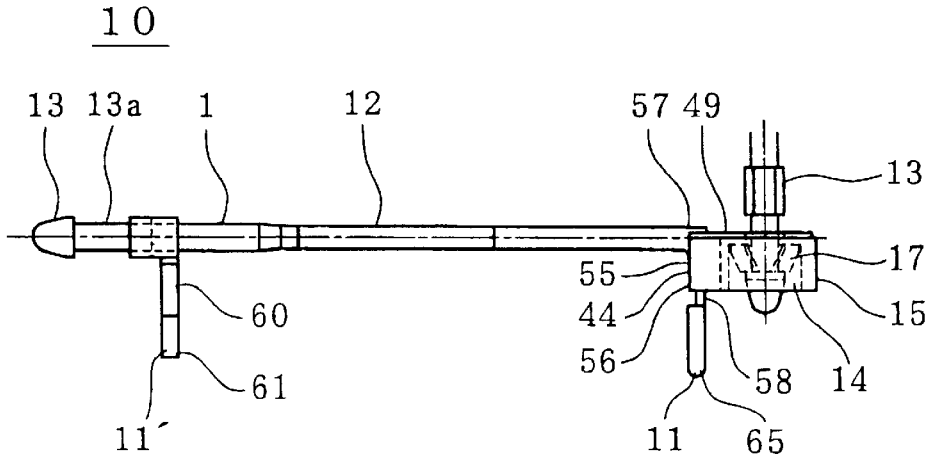
FIG. 2 is a side view showing the configuration of one specific example of the sealing implement related to the present invention.
Figure 3:
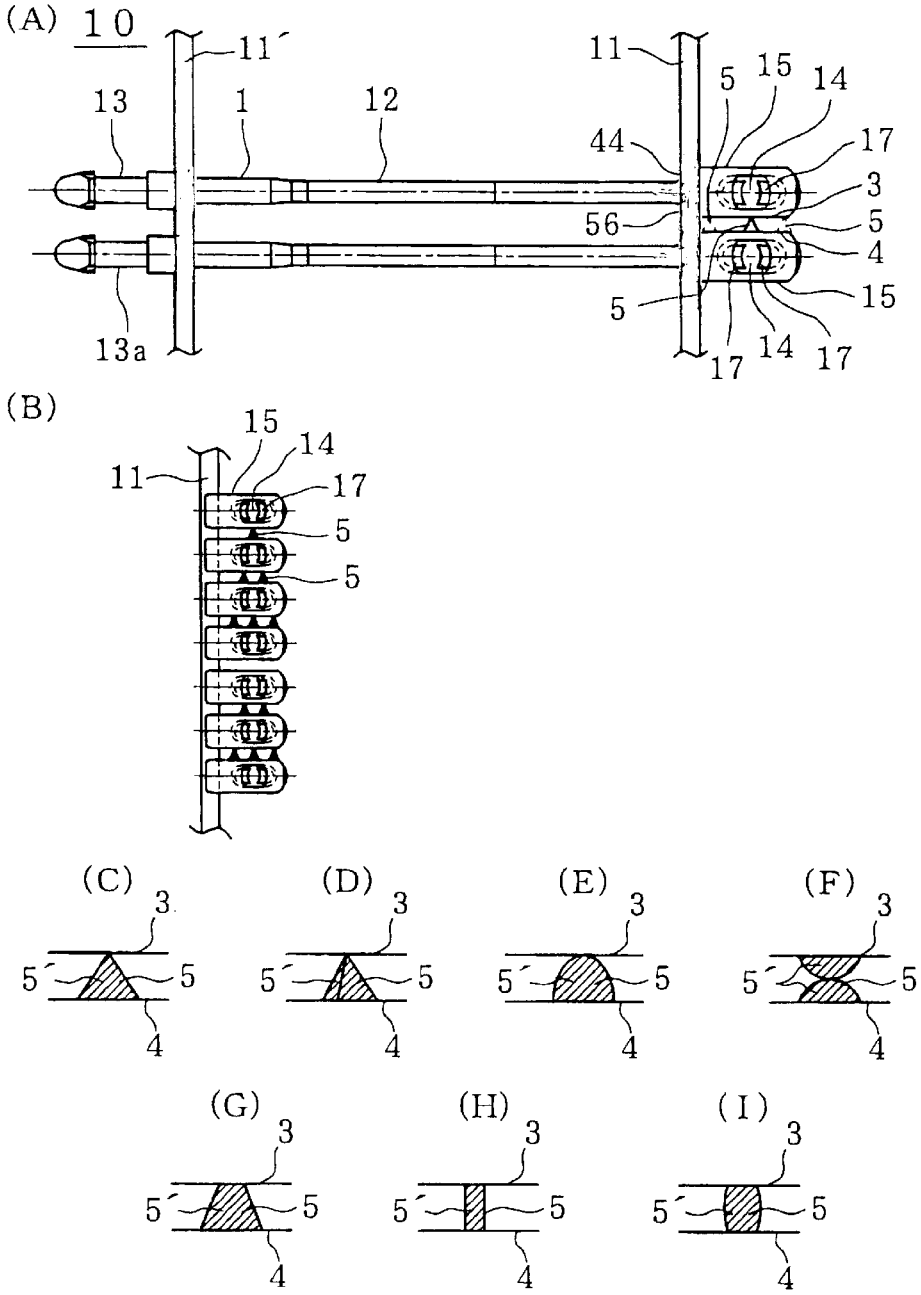

That is, FIG. 1 is a front view showing a configuration of one specific example of the sealing implement related to the present invention and FIG. 2 is a side view thereof and FIG. 3 is a back side view thereof.

Note that in these FIGS., it is disclosed that an unit of sealing implement 10 comprising a plurality of single sealing implements 1 each one of which comprising, a flexible filament part 12, an insertion head part 13 having an appropriate engaging part 13*a* provided on one end part of the filament part 12 and a socket part 15 having a hole 14 for the purpose of irreversibly inserting the insertion head part 13, and provided on another end of the filament 12, and wherein a plurality of the single sealing implements 1 are mutually and adjacently arranged in parallel with each other and each of the plurality of insertion head parts 13 or a portion proximity thereto and each of the plurality of socket parts 15 or a portion proximity thereto being caused to be connected to separately provided connecting bars 11, 11', respectively, and further wherein each of side wall surfaces 3, 4 of the socket part 15 each being adjacently arranged to each other, and which being oppositely disposed to each other, are connected with each other via a connecting means 5.

The sealing implement 10 according to the present invention is integrally molded generally with synthetic resin such as nylon, polypropylene, polyester, etc. as in the case of conventional sealing implements.

Referring now to FIG. 1, one specific example of the sealing implement 10 related to the present invention will be further described.

First of all, the basic configuration of the sealing implement 10 related to the present invention is nearly the same as that of the conventional sealing implement, and further at the socket section 15, an insertion hole 14 for irreversibly passing the inserting head section 13 is provided.

In the present invention, the cross-sectional profile of the filament part 12 may be any of circle, flattened shape, or rectangle.

To the insertion hole 14 of the socket section 15, an engaging section 17 to which the engaging section 13*a* formed on a part of the insertion head part 13 and having a diameter reduced so as to form a stepwise configuration is provided and the engaging section 17 is formed so as to project inside of the hole 14 from an inside surface thereof and to enable to be deformed.

In the present invention, as shown in FIGS. 1 to 3, one of the connecting bar 11 is connected to an end base portion or a portion proximity thereto of the socket parts 15 each being adjacently arranged to each other and additionally a pair of the socket parts 15 adjacently arranged to each other are connected to each other with a suitable connecting means 5 so as to be mutually fixed.

That is to say, in the present invention, the side wall surfaces 3, 4 of a plurality of the socket parts 15, 15', each adjacently arranged to each other, and adjacently facing to each other, are connected with each other with utilizing at least one connecting means 5.

Accordingly, in the present invention, since each one of the socket part 15 is connected with the connecting bar 11 and the connecting means 5 in an lower portion and an upper portion thereof, even when it is shot out with a gun, the arrangement direction of the socket part can be prevented from being deformed.

In the present invention, at least one the connecting means 5 can be provided between a pair of the side wall surfaces 3, 4 of the respective socket parts 15 of an unit of the sealing implement 10, adjacently arranged to each other and oppositely disposed to each other and preferably two or more than two of the connecting means 5 can be provided thereto.

Note that, in the sealing implement 10 of the present invention, as shown in FIG. 1, one connecting means 5 is provided all of portions formed between a pair of the side wall surfaces 3, 4 of the respective socket parts 15 of an unit of the sealing implement 10, adjacently arranged to each other and oppositely disposed to each other but it is also prefer that two or three connecting means 5 are provided all of portions formed between a pair of the side wall surfaces 3, 4 of the respective socket parts 15 of an unit of the sealing implement 10, adjacently arranged to each other and oppositely disposed to each other.

Additionally, in the present invention, as shown in FIG. 3(B), different number of the connecting means 5 can be provided in the portion formed between the side wall surfaces 3, 4 of the respective socket parts 15 adjacently arranged to each other.

In the present invention, the connecting means 5 preferably has a fine configuration through over-all portion thereof or a configuration having a portion which can attach to a side wall surface 3, 4 of the socket part 15 or attach to an opposite connecting means 5 via a pin point connection, so that it can be easily broken when a predetermined tensile strength or a predetermined shearing force is applied to the socket part 15.

In another word, the connecting means 5 of the present invention, has a suitable connecting strength between the side wall surface 3 and 4 of the socket part 15 to an extent with which the socket part 15 can be easily separated.

It should be understood that the socket parts 15 of the unit of sealing implements 10 each being adjacently arranged to each other are temporarily fixed to each other at a portion other than the connecting bar 11.

The connecting means 5 of the present invention, as shown in FIG. 3(C) to FIG. 3(I), preferably comprises a thin and short connecting member 5' and this may be formed integrally with the socket part 15 when the socket part 15 is formed with a plastic molding method. As shown in FIG. 3(H), the connecting member 5' forming the connecting means 5 has an uniform cross-sectional area in overall length thereof along a center axis thereof and thus it may a column or a rod having a polygonal cross-sectional configuration or the like, or has a non-uniform cross-sectional area in overall length thereof along a center axis of the connecting member 5' as shown in FIG. 3(C) to FIG. 3(G) and FIG. 3(I).

For example, in the connecting means 5 of the present invention, at least one end portion of the connecting member 5' forming the connecting means 5, may have any one of configuration selected form a group consisting a circular corn type shape, a spherical shape, a semi-spherical shape, a pyramid type shape or the like as shown in FIG. 3(C) to FIG. 3(F).

Note that, the configuration of the connecting member 5' may have a configuration which can contact to the side wall surfaces 3, 4 of the socket part 15 via a pin-point connection or the opposite connecting members 5' can be mutually connected to each other via a pin-point connection.

On the other hand, one end of the connecting member 5' can be connected to the sidewall surface 3 or 4 of the socket part 15 via a surface contacting manner the connecting portion of the connecting member 5' having a small cross-sectional area.

That is to say, in the present invention, it is also preferable that a cross-sectional area of one end portion of the connecting member 5' of the connecting means 5, which contacting to one of the side wall surface 3 of the side wall surfaces 3, 4 of a pair of the socket parts 15 each being adjacently arranged to each other, is different from a cross-sectional area of another end portion of the connecting member 5' of the connecting means 5, which contacting to another side wall surface 4 of the pair of the socket parts.

The cross-sectional area of one end portion of the connecting member 5' and connected to the side wall surface is a cross-sectional area showing a connecting force to an extent with which a pair of the socket parts 15 can be easily separated from each other when a certain external force is applied thereto.

The connecting means 5 of the present invention may be formed by projecting the respective connecting members 5', 5' from each one of the side wall surfaces 3 and 4 of the socket parts 15 being adjacently arranged to each other, respectively, and both of the tip ends being contacted to each other at the middle portion between both side wall surfaces 3 and 4, as shown in FIG. 3(F).

As further separate embodiment of the present invention, as shown in FIG. 3(B), some of portions formed between two adjacently arranged socket parts 15 are provide with no such connecting means 5 with a predetermined interval.

In the present invention, a cross-sectional configuration of the connecting member of the connecting means is a configuration selected from a group consisting a circular type configuration, an ellipse type configuration, a rectangular type configuration, a flat type configuration, semi-circular type configuration, a polygonal type configuration or a composite type configuration formed by combining at least two of aforementioned configurations to each other.

Figure 12:
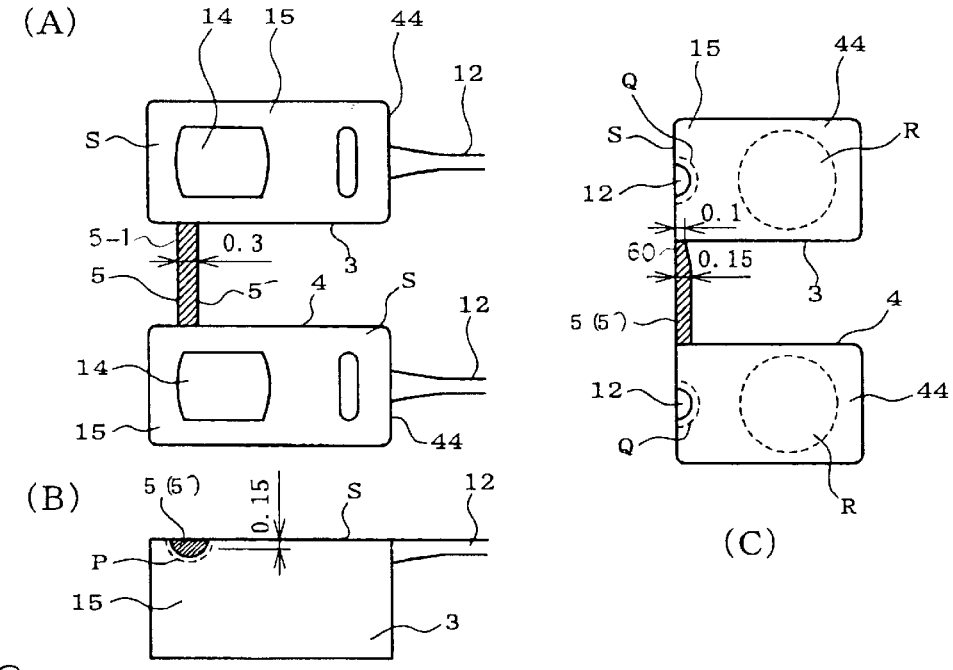
FIGS. 12(A)–12(C) are views showing further separate embodiment of the connecting means as used in the present invention.
Figure 13:
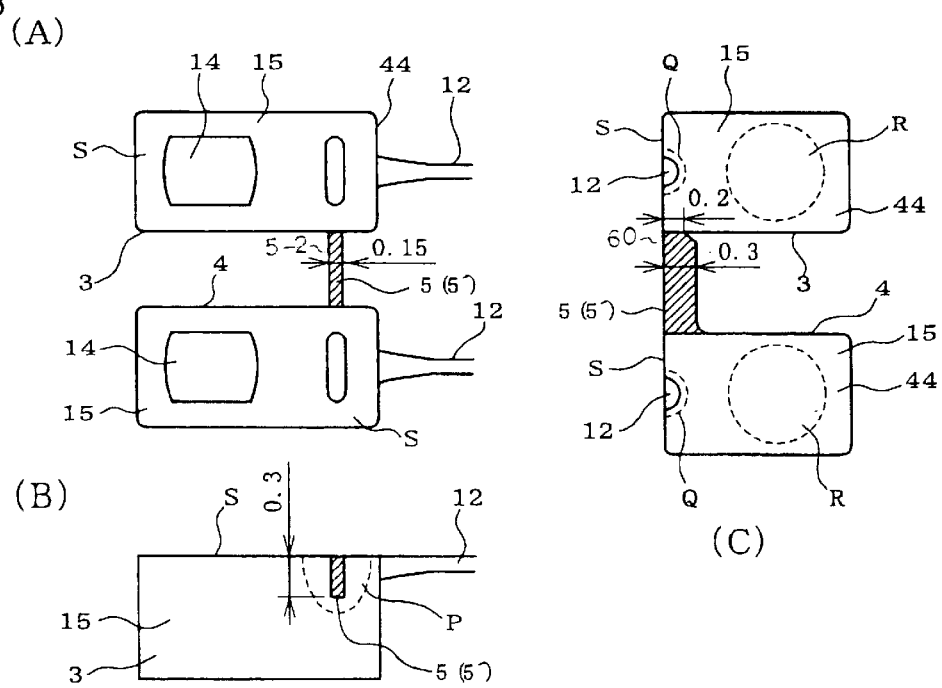
FIGS. 13(A)–13(C) are views showing further separate embodiment of the connecting means as used in the present invention.

On the other hand, in the sealing implement 1 of the present invention, the connecting means 5 can be formed at any portion of the side wall surface 3 or 4 of the socket part 15 but as a preferable embodiment of the present invention, as shown in FIGS. 12 and 13, the connecting means 5 is provided on a position P on the side wall surface 3 or 4 of the socket part 15 and which locating at a position communicating to or proximity of a top surface S of the socket part 15 to which the filament part 12 is contacted and on which an insertion hole 14 into which the insertion head part 13 is inserted, is provided.

In the present invention, when only one of the connecting means 5 is provided therebetween, it is preferable that the connecting member 5' may be provided on a position formed on a side wall surface 3, 4 of the socket part 15 and located so that a distance formed between the connecting member 5' and the connecting bar 11 can be set as long as possible.

In this case, a moment for suppressing the deformation of the socket part 15 will become maximum so that the most preferable position fixing effect for the socket part 15 can be obtained.

On the other hand, in the present invention, the connecting member 5' can also be provided on a position formed on a side wall surface 3, 4 of the socket part 15 and located so that a distance formed between the connecting member 5' and the connecting bar 11 can be set as short as possible.

In this case, an effect of a surface of a good being prevented from being scratched by a residual connecting member 5', can be obtained.

Of course, in the present invention, a plurality of the connecting means 5 can be provided between a pair of the side wall surfaces 3, 4 of the respective socket parts 15 adjacently arranged to each other and oppositely disposed to each other.

A further separate embodiment of the present invention will be explained hereunder.

In the present invention, in a case when a plurality of connecting means 5 are used and when each one of the connecting member 5' of the connecting means 5 having a cross-sectional configuration which being selected from a group consisting an ellipse type configuration, a rectangular type configuration, a flat type configuration and a semi-circular type configuration, each having a major axis, wherein an arranging direction of a major axis of the cross-sectional configuration of one of the connecting member 5' is different from an arranging direction of a major axis of the cross-sectional configuration of another connecting member 5'.

More specifically, in this embodiment, as shown in FIGS. 12 and 13, the connecting member 5'-1 which is locating at a position far from the connecting bar 11 has a flat type cross-sectional configuration with a width of, for example, 0.3 mm and a thickness of, for example, 0.15 mm as shown in FIG. 12(A) and FIG. 12(B) and it is arranged so that a width direction thereof is set in a direction in parallel with a surface direction of the upper surface S of the socket part 15 and while, as shown in FIG. 12(C), between the side wall surface 3 and 4 of the respective adjacently arranged socket parts 15, one end portion 60 of the connecting member 5' which is connecting to the side wall surface 3 is formed to have a configuration in that a cross-sectional area being gradually narrowed toward the tip end portion thereof.

Note that, in this embodiment, the major axis of the cross-sectional configuration of the connecting member 5'-1 forming the connecting means 5, which locating at a position far form the connecting bar 11 is set at a direction being in parallel with the surface direction of the upper surface S of the socket part 15 or with a direction of a center axis of the filament part 12.

On the other hand, the connecting member 5'-2 forming the connecting means 5, which is locating at a position closer to the connecting bar 11, has a flat type cross-sectional configuration with a width of, for example, 0.3 mm and a thickness of, for example, 0.15 mm as shown in FIG. 13(A) and FIG. 13(B) and it is arranged so that a width direction thereof is set at a direction perpendicular to a surface direction of the upper surface S of the socket part 15 and while, as shown in FIG. 13(C), between the side wall surface 3 and 4 of the respective adjacently arranged socket parts 15, one end portion 60 of the connecting member 5' which is connecting to the side wall surface 3 is formed to have a configuration in that a cross-sectional area being gradually narrowed toward the tip end portion thereof.

Note that, in this embodiment, the major axis of the cross-sectional configuration of the connecting member 5'-2 forming the connecting means 5, which locating at a position closer to the connecting bar 11 is set at a direction perpendicular to the surface direction of the upper surface S of the socket part 15 or perpendicular to a direction of a center axis of the filament part 12.

In the present invention, a condition of an arrangement for a plurality of the socket parts 15 being adjacently arranged to each other is constantly uniform whole of the unit 10 and each of the socket parts 15 is so fixed to each other so as not to be deformed easily.

Accordingly, in the present invention, each one of the sealing implement 1 can be easily separated from the connecting bar and shot out one by one, by operating an operation lever 18*a* provided on the gun 18, so that a tag or a label can be attached to a good.

As mentioned above, the unit of sealing implement of the present invention, is so configured that a direction of a major axis of the cross-sectional configuration of the connecting member of the connecting means provided at a position located relatively far from the connecting bar, is arranged so as to comply with a surface direction of an upper surface of the socket part, while a direction of a major axis of the cross-sectional configuration of the connecting member of the connecting means provided at a position located relatively closer to the connecting bar, is arranged so as to comply with a direction perpendicular to the surface direction of the upper surface of the socket part.

Figure 10:
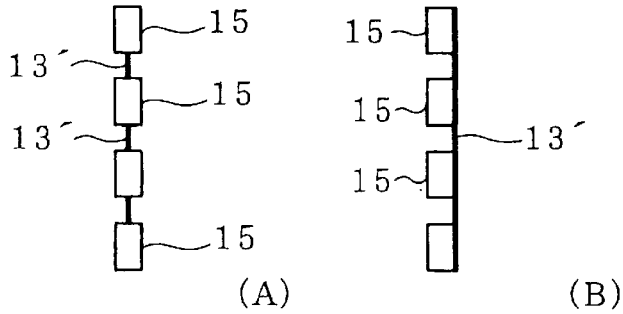
FIGS. 10(A)–10(B) are views showing another embodiment of the connecting means as used in the present invention.
Figure 11:
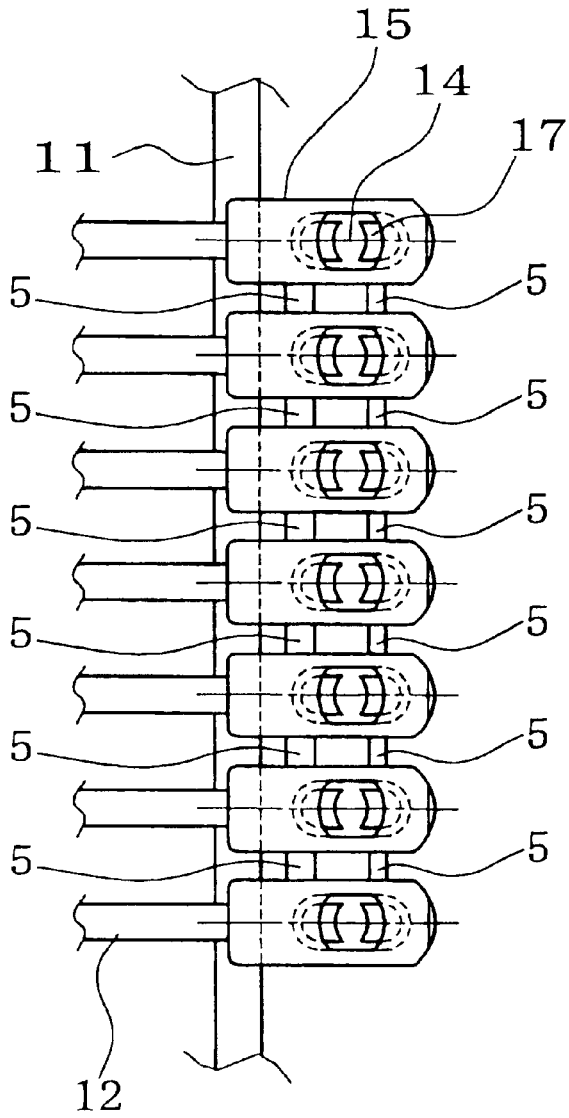
FIG. 11 is a view showing separate embodiment of the connecting means as used in the present invention.

Additionally, as one of further different embodiment of the present invention, a connecting means 5 formed into a fine string configuration 13' can also be used as shown in FIG. 10(A) and FIG. 10(B).

The filament section used in the sealing implement related to the present invention may have any kind of cross sectional configuration selected one from a group consisting form a circle type, flattened shape type, an ellipse type, a rectangular type or the like. In addition, the size of the socket part is preferably visually small enough for enabling easy handling.

Figure 4:
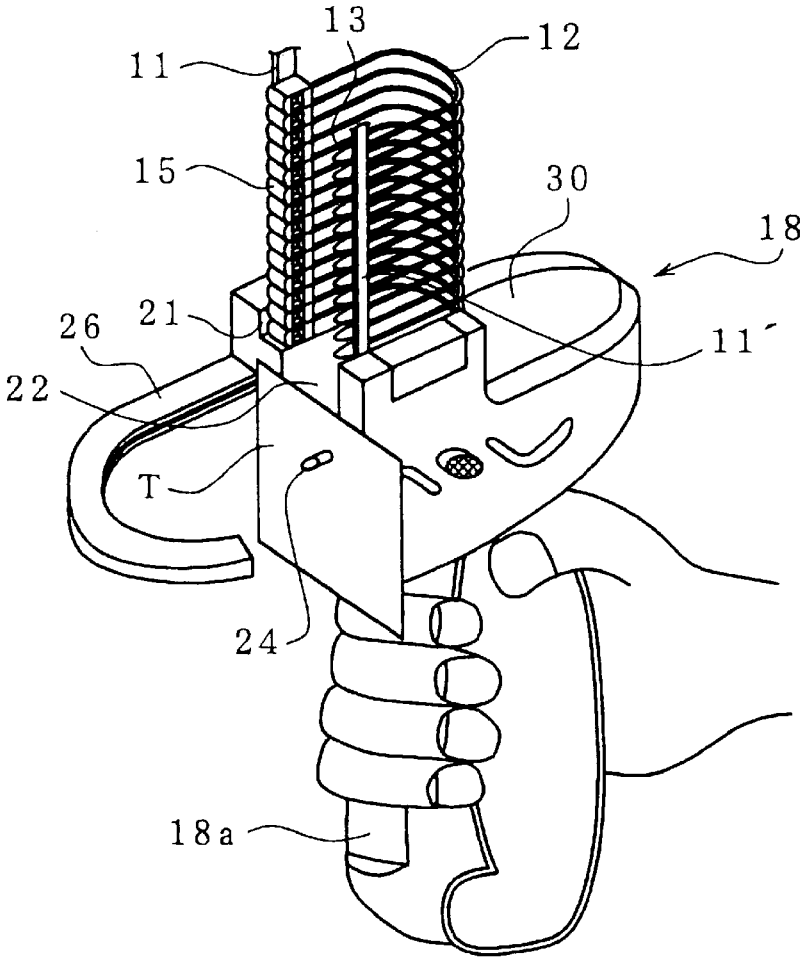
FIG. 4 is a perspective view showing the condition in which the sealing implement according to the present invention is set to the special-purpose tag attaching tool (gun)
Figure 5:
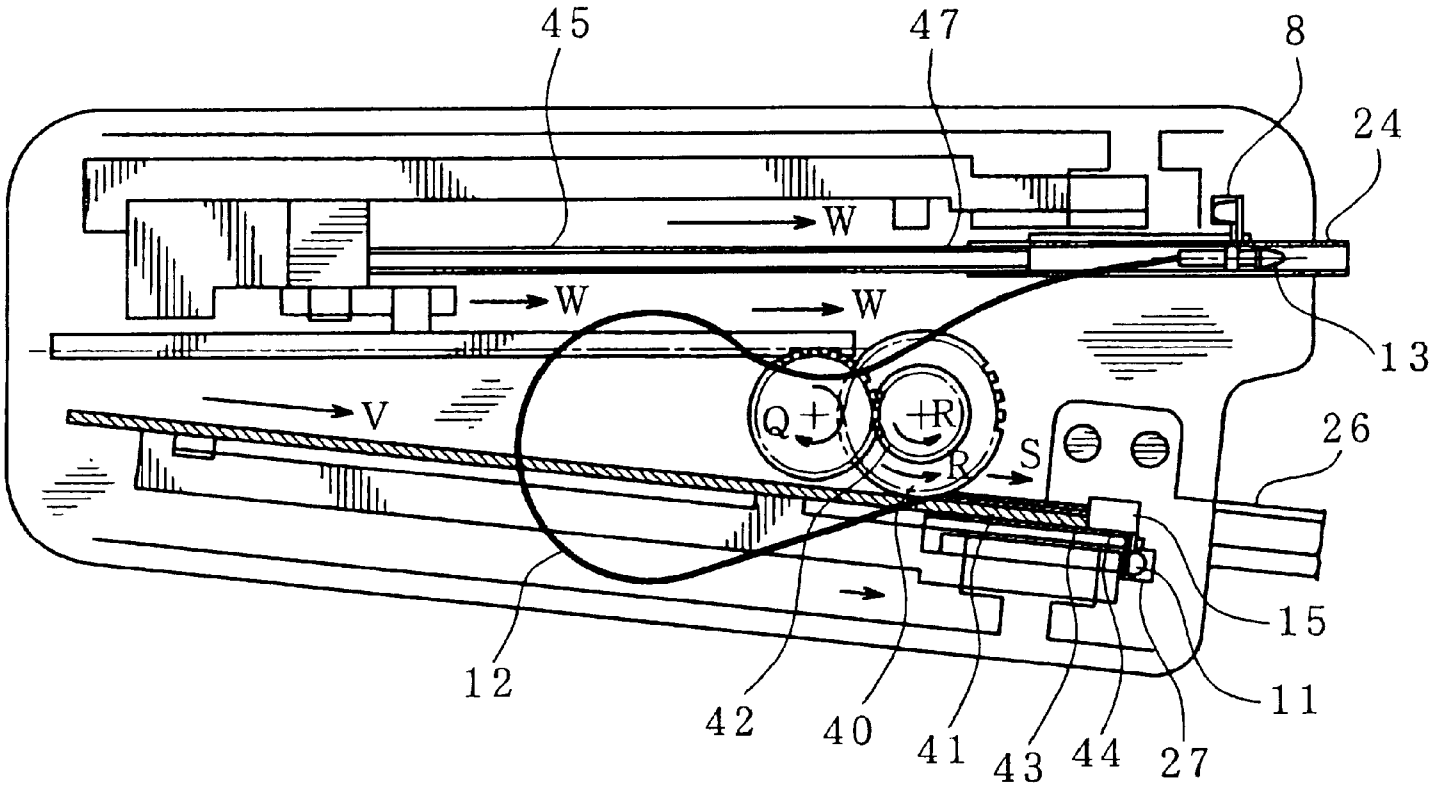
FIG. 5 is a plane view showing a sealing implement shooting mechanism of a gun as shown in FIG. 4.
Figure 6:
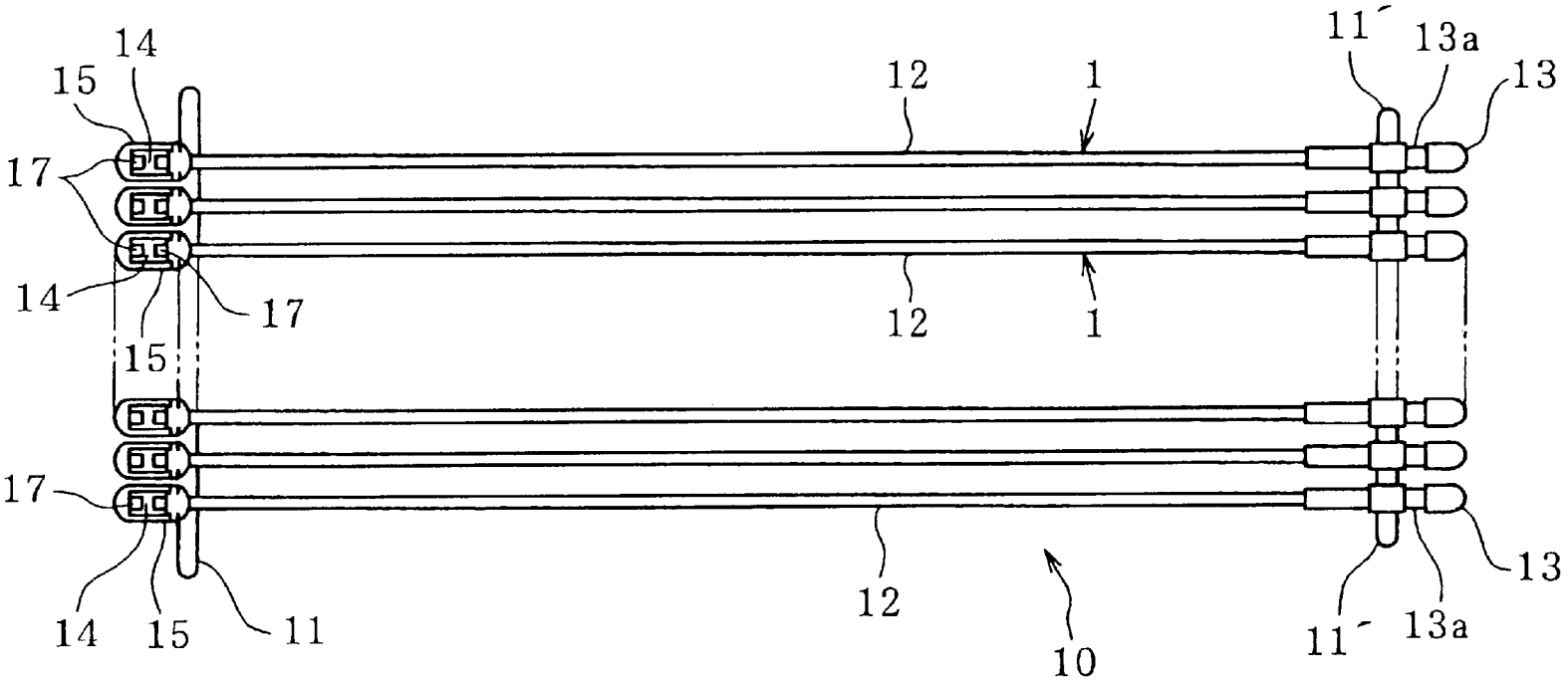
FIG. 6 is a plan view showing an essential part of one embodiment of the conventional sealing implement.
Figure 7:
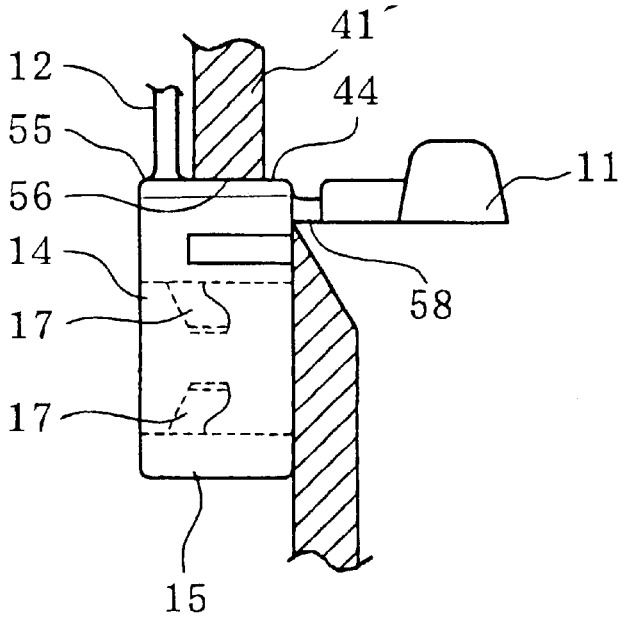
FIG. 7(A) and FIG. 7(B) are enlarged side and plane views of a socket part of a conventional sealing implement, respectively.
Figure 7:
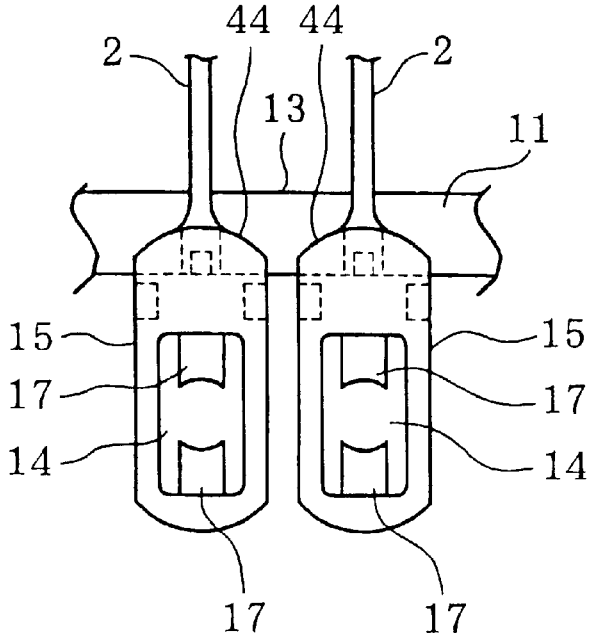

On the other hand, in the present invention, as shown in FIG. 4, a socket part 15 connected to the connecting bar 11 inserted into the vertical groove 21, is separated from the connecting section 58 of the connecting bar 11 by the fist pushing means 41 and pushed out one by one forward along the curved socket guide 26 without any jamming condition.

By doing this, the socket part 15 pushed out along the socket guide 26 is turned its direction by an angle of 90° and fits with the inserting head part 13 pushed out by the pushing pin 47 of the second pushing means 45, at the front end of the socket guide 26, through the insertion hole 14.

For this reason, the socket guide 26 changes its longitudinal direction by about 90° with a cylindrical tube so that a rod serving as the pushing means 41 is able to advance inside thereof while being bent.

And it is configured in such a manner that the timing of the head end of the pushing rod 41 reaches the top end of the socket guide 26 coincides with the timing of the pushing pin 47 reaching the same top end of the socket guide 26.

In this way, the sealing implement 1 is able to attach labels successively and continuously to products, etc.

For another embodiment of the present invention, it is preferable that the socket part 15 and the filament part 12 are connected to each other at a position Q being approximately a center portion of the side wall surface 3, 4 of the socket part 15 and facing to a side at which the filament part 12 is existing, and the position Q locating on a portion of or proximity thereto an area at which an upper surface S of the socket part 15 on which the insertion hole 14 is provided, intersecting with the side wall surface 44.

And in a further separate embodiment of the present invention, a surface of the side wall surface 44 of the socket part 15 facing to a side at which the filament part 12 is existing, is flat and a surface direction of the surface of the side wall surface 44 being perpendicular to a direction of a center axis of the filament part 12.

In the present invention, by adopting the above-mentioned configuration, following effect can be expected.

Figure 8:
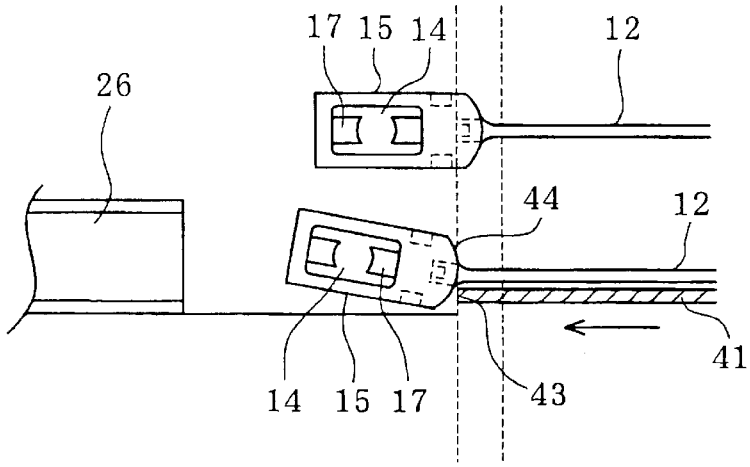
FIG. 8(A) and FIG. 8(B) are views explaining problems occurred in the conventional sealing implement.
Figure 8:
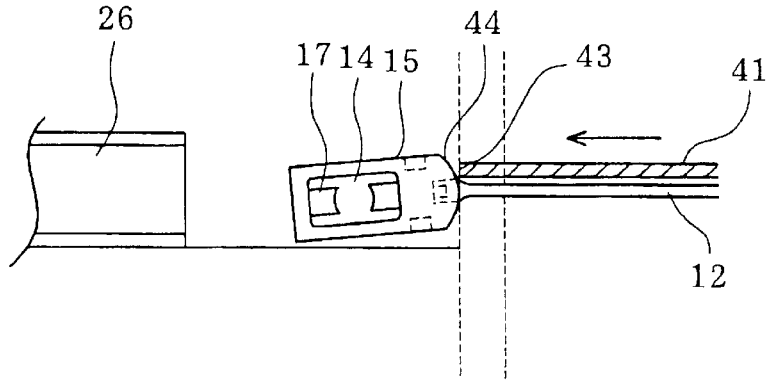
Figure 9:
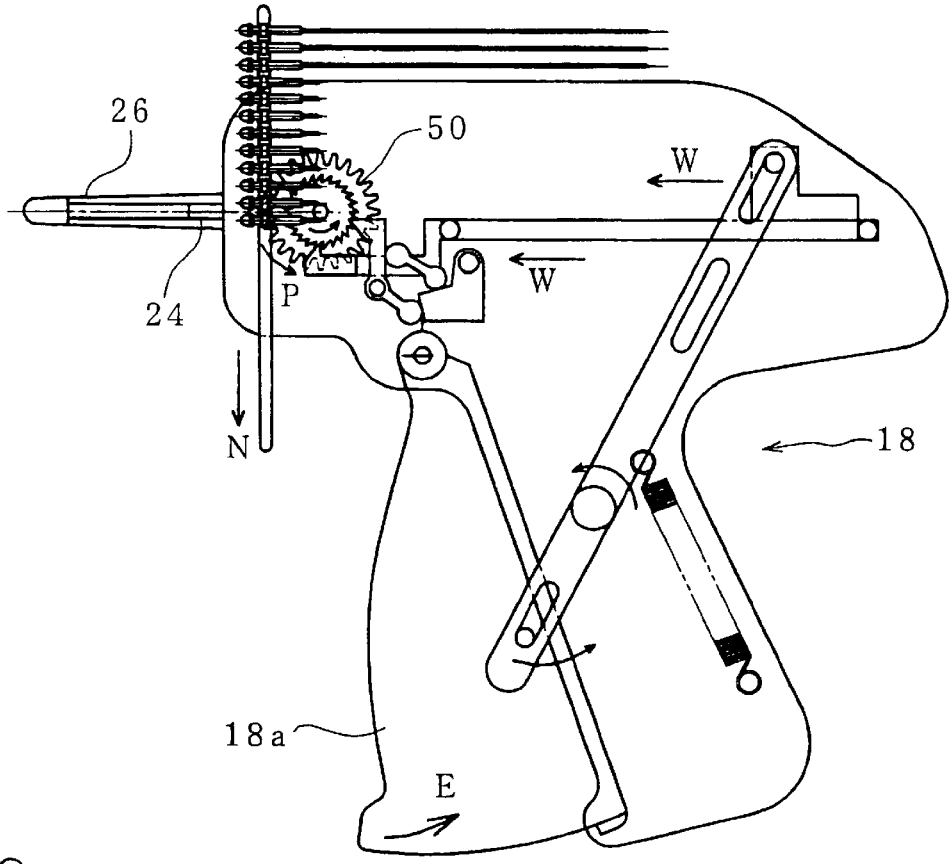
FIG. 9 is a side view showing a sealing implement transferring mechanism of a conventional gun.

For example, an surface area of a region R of the socket part 15, to which a tip portion of the pushing rod 41 is attached, can be substantially enlarged and thus the operational efficiency can be greatly improved and simultaneously with this, since the surface of the region R is formed in a direction being perpendicular to a direction along which the tip portion of the pushing rod 41 is pushed out, a problem in that the socket part 15 is pushed out under a condition of a center axis of socket part 15 being deformed as shown in FIG. 8, can be completely avoided when the tip end of the pushing rod 41 attaches with the side wall surface 44 of the socket part 15.

Further, in the sealing implement 10 of the present invention, since a plurality of the connecting means 5 are disposed at every space formed between every two socket parts being adjacently arranged to each other, when a plurality of unit of the sealing implements 10 are stacked each other and stored inside storage box and delivered and then they are taken out therefrom at an operation site, respectively, a conventional problem under which a lots of extra works for taking out each one of the unit of sealing implement has been required due to entanglement between the filament part and the socket part caused by a fact that the filament parts 12 of the sealing implement 10 are inserted into spaces formed between every two adjacently arranged socket parts, can be completely avoided.

Because the present invention adopts the configuration as described above, since a deformation of the arrangement configuration of the socket part 15 is prevented after the sealing implement has been mounted on the gun and when each one of the socket part 15 is pushed out by a predetermined pushing means, one by one, no jamming condition can be occurred caused by a pushing direction of the top end portion of the socket part 15 being changed.

Accordingly, in the present invention, a stop of the operation due to an occurrence of such jammed condition is avoided and no malfunction over the gun is expected as well as an extra operation for resolving such jamming condition is no more required and these facts reducing in great improvements over such operational efficiency.

In addition to this, it is possible for each one of the units of sealing implements to be easily taken out from its stacked stocks thereof or from a container thereof.

What is claimed is:

1. An unit of sealing implements comprising a plurality of single sealing implements each one of which comprising:

a flexible filament part;

an insertion head part having an appropriate engaging part provided on one end part of said filament part; and a socket part having a hole for the purpose of irreversibly inserting said insertion head part, and provided on another end of said filament, wherein a plurality of said single sealing implements are mutually and adjacently arranged in parallel with each other and each of said plurality of insertion head parts or a portion proximity thereto and each of said plurality of socket parts or a portion proximity thereto being caused to be connected to separately provided connecting bars, respectively, and further wherein each of side wall surfaces of said socket part each being adjacently arranged to each other, and which being oppositely disposed to each other, are connected with each other via a connecting means.

2. An unit of sealing implement according to claim 1, wherein, at least one said connecting means is provided between a pair of said side wall surfaces of the respective socket parts adjacently arranged to each other and oppositely disposed to each other.

3. An unit of sealing implement according to claims 1 or 2, wherein, said connecting means having a connecting strength to an extent so that said socket parts connected to each other, can be easily separated from each other.

4. An unit of sealing implement according to claims 1 or 2, wherein, said connecting means comprising a connecting member having an uniform cross-sectional area in overall length thereof along a center axis thereof.

5. An unit of sealing implement according to claims 1 or 2, wherein, said connecting means comprising a connecting member having non-uniform cross-sectional area in overall length thereof along a center axis thereof.

6. An unit of sealing implement according to claim 5, wherein, a cross-sectional area of one end portion of said connecting member of said connecting means, which contacting to one of said side wall surfaces of a pair of said socket parts each being adjacently arranged to each other, is different from a cross-sectional area of another end portion of said connecting member of said connecting means, which contacting to another side wall surfaces of said pair of said socket parts.

7. An unit of sealing implement according to claim 6, wherein, a cross-sectional area of at least one end portion of said connecting member of said connecting means, which contacting to one of said oppositely disposed side wall surfaces of a pair of said socket parts each being adjacently arranged to each other, has a connecting force so that said socket parts can be easily separated from each other when a predetermined external force is applied to said socket part.

8. An unit of sealing implement according to claims 1 or 2, wherein a cross-sectional configuration of said connecting member of said connecting means is a configuration selected from a group consisting of a circular type configuration, an ellipse type configuration, a rectangular type configuration, a flat type configuration, semi-circular type configuration, a polygonal type configuration or a composite type configuration formed by combining at least two of aforementioned configurations to each other.

9. An unit of sealing implement according to claims 1 or 2, wherein, at least one end portion of said connecting member of said connecting means connecting to a portion of said side wall surface of said socket part through a point contacting manner.

10. An unit of sealing implement according to claims 1 or 2, wherein, said connecting means is provided on a portion on said side wall surface of said socket part and said portion thereof being disposed at a position complying with or proximity to one of surfaces of said socket part at which said filament part being connected thereto.

11. An unit of sealing implement according to claims 1 or 2, wherein, said connecting means is provided on a position formed on a side wall surface of said socket part and located so that a distance formed between said connecting means and said connecting bar can be set as long as possible.

12. An unit of sealing implement according to claims 1 or 2, wherein, said connecting means is provided on a position formed on a side wall surface of said socket part and located so that a distance formed between said connecting means and said connecting bar can be set as short as possible.

13. An unit of sealing implement according to claims 1 or 2, wherein, a plurality of said connecting means are provided between a pair of said side wall surfaces of the respective socket parts adjacently arranged to each other and oppositely disposed to each other.

14. An unit of sealing implements according to claim 13, wherein, in a case when a plurality of connecting means are used and when each one of said connecting means having a cross-sectional configuration which being selected from a group consisting an ellipse type configuration, a rectangular type configuration, a flat type configuration and a semi-circular type configuration, wherein an arranging direction of a long axis of said cross-sectional configuration of one of said connecting member is different from that of another connecting member.

15. An unit of sealing implement according to claim 14, wherein, a direction of a major axis of said cross-sectional configuration of said connecting member of said connecting means provided at a position located relatively far from said connecting bar, is arranged so as to comply with a surface direction of an upper surface of said socket part, while a direction of a major axis of said cross-sectional configuration of said connecting member of said connecting means provided at a position located relatively closer to said connecting bar, is arranged so as to comply with a direction perpendicular to said surface direction of said upper surface of said socket part.

16. An unit of sealing implement according to claims 1 or 2, wherein, a condition of an arrangement for a plurality of said socket parts being adjacently arranged to each other is constantly uniform whole of said unit and each of said socket parts is so fixed to each other so as not to be deformed easily.

17. An unit of sealing implement according to claims 1 or 2, wherein, said socket part and said filament part are connected to each other at a position being approximately a center portion of said side wall surface of said socket part and facing to a side at which said filament part existing, and said portion locating on a portion of or proximity thereto an area at which an upper surface of said socket part on which said insertion hole is provided, intersecting with said side wall surface.

18. An unit of sealing implement according to claim 17, wherein, a surface of said side wall surface of said socket part facing to a side at which said filament part is existing, is flat and a surface direction of said surface of said side wall surface being perpendicular to a direction of a center axis of said filament part.

* * * * *